United States Patent [19]

Pivert et al.

[11] Patent Number: 4,905,835

[45] Date of Patent: Mar. 6, 1990

[54] INFLATABLE CUSHION PACKAGING

[75] Inventors: Alain Pivert, Levallois Perret; Michel L. Pozzo, Neuilly sur Seine, both of France

[73] Assignee: Apple Computer France, Sarl, France

[21] Appl. No.: 288,799

[22] Filed: Dec. 22, 1988

[30] Foreign Application Priority Data

Dec. 24, 1987 [FR] France ..... 87 18176

[51] Int. Cl.[4] ..... B65D 81/02

[52] U.S. Cl. ..... 206/522; 206/591; 383/3; 220/4 B; 220/4 E

[58] Field of Search ..... 206/522, 525, 585, 591, 206/593; 383/3; 220/4 B, 4 E, 403

[56] References Cited

U.S. PATENT DOCUMENTS

| | | | |
|---|---|---|---|
| 3,720,240 | 5/1973 | Presnick | 150/2.5 |
| 3,770,187 | 11/1973 | Faires et al. | 229/39 R |
| 3,889,743 | 6/1975 | Presnick | 206/522 |
| 4,091,852 | 5/1978 | Jordan et al. | 206/522 |
| 4,103,810 | 8/1978 | Hickey | 206/522 |
| 4,384,603 | 5/1983 | Tyler et al. | 383/3 |

FOREIGN PATENT DOCUMENTS 848248 9/1960 United Kingdom .

8500151 1/1985 United Kingdom .

*Primary Examiner*—David T. Fidei

*Attorney, Agent, or Firm*—Blakely, Sokoloff, Taylor & Zafman

[57] ABSTRACT

Packaging of the type comprising an outer rectangular box (100) of rigid cardboard or the like, and a flexible inflatable structure (200, 300) situated inside the box and comprising, overlying each of the inside faces of the box, an inflatable cushion for coming into close contact with the article to be packaged. The box includes a bottom closure (120) and a top closure (130) each having self-locking flaps. The inflatable structure comprises two unit assemblies (200, 300) each comprising a central cushion (220, 330) overlying a respective one of the closures (120, 130) of the box, and two side cushions (211, 213; 312, 314) overlying respective side walls (111, 113; 112, 114) of the box, with each assembly further including means (270–274; 370–374; 500) for simultaneously inflating its three cushions, with at least one of the assemblies being inflatable from outside the box. The bottom and top closures of the box are held in the locked position by the pressure exerted thereon by the respective central cushions of the two assemblies (200, 300) of the inflatable structure, once inflated.

13 Claims, 5 Drawing Sheets

INFLATABLE CUSHION PACKAGING

The present invention relates in general to packaging, and it relates more particularly to packaging comprising a generally rigid outer box having a flexible inflatable structure provided inside the box for closely engaging the object(s) to be packaged.

INFORMATION DISCLOSURE STATEMENT

The prior art includes several examples of packaging of this type.

More particularly, French patent document FR-A-2,063,701 teaches packaging comprising a rigid box which may be rectangular, for example, with six inflatable cushions disposed against its inside walls. Each cushion includes an inflation tube which passes through a perforation formed in the corresponding face of the box in order to enable it to be inflated from outside the box.

Thus, after inflation, the object inside the packaging is intimately wedged between the inside faces of the cushions which, by virtue of their deformability adapt themselves to the shape of the object.

In addition, such packaging may be used for packaging articles of a wide variety of shapes and sizes, with the articles being held fast appropriately on each occasion.

The object can thus be transported and subjected to severe conditions while minimizing any risk of it being damaged. The cushions absorb shock to a greater extent than is possible using rigid wedging means. In addition, such cushions provide thermal insulation and, in some applications, they are advantageous in that they make the box unsinkable.

However, this type of prior art packaging nevertheless suffers from certain drawbacks.

Firstly, the inflation operation is tedious insofar as the six cushions need to be inflated in succession. Further, this type of internal inflatable structure is quite unsuited to boxes made of cardboard or the like which are closed by flaps that are held together by adhesive tape or by staples. If the box is opened by means of a sharp or a pointed tool, it is highly likely that at least one of the cushions will be punctured, thereby making the packaging unsuitable for further use.

Finally, it may be observed that such packaging requires optimum inflation, with each cushion being inflated to a determined air pressure. More precisely, if the cushions are under-inflated, then the object is poorly held in place and shocks are absorbed inadequately, whereas if the cushions are over-inflated, then there is the danger that a cushion will burst.

Finally, this type of prior art packaging suffers from a third major drawback due to the fact that there are no simple means for determining the instant at which optimum inflation of a cushion has been achieved.

In addition, French patent document FR-A-2,131,417 describes packaging of the above-mentioned type in which it is proposed that the cushions should communicate with one another either completely or in part. The operation of inflation is thus facilitated, but the other drawbacks remain. Furthermore, accidentally puncturing one of the cushions is even more disadvantageous in that all of the cushions in communication therewith are then deflated.

SUMMARY OF THE INVENTION

The present invention seeks to mitigate the drawbacks of the prior art and to provide packaging of the type described in the introduction in which the various cushions or the like can be inflated easily and quickly. Another object of the invention is to provide packaging comprising a box of cardboard or the like which does not require closure means using staples or an adhesive strip, thereby avoiding any risk of the cushions being punctured by a tool used for opening the packaging.

Correspondingly, another object of the invention is to provide packaging in which inflating the internal inflatable structure ensures, or at least reinforces, tamper-proof closure of the box of cardboard or the like so that the box can be opened normally only after it has been deflated, at least in part, but without requiring the use of a tool or the like.

Finally, in correspondence with the above, another object of the invention is to provide packaging in which optimum inflation can be obtained in a manner which is extremely simple and without requiring any kind of pressure measurement.

To this end, the present invention provides packaging of the type comprising an outer rectangular box of rigid cardboard or the like, and a flexible inflatable structure situated inside the box and comprising, overlying each of the inside faces of the box, an inflatable cushion for coming into close contact with the article to be packaged, the packaging being characterized in that:

the box includes a bottom closure and a top closure each having self-locking flaps;

the inflatable structure comprises two unit assemblies each comprising a central cushion overlying a respective one of the closures of the box, and two edge cushions overlying respective side walls of the box, with each assembly further including means for simultaneously inflating its three cushions, with at least one of the assemblies being inflatable from outside the box; and the bottom and top closures of the box are held in the locked position by the pressure exerted thereon by the respective central cushions of the two assemblies of the inflatable structure, once inflated.

Various features which are preferred, but not essential, for packaging in accordance with the invention are mentioned below:

each of the top and bottom closures of the box includes two first opposite flaps each having two slots for receiving secondary tongues associated with two second flaps, with one of the second flaps also including a main tongue for engaging in a middle slot associated with the other second flap;

each assembly of the inflatable structure is made by peripherally welding together two sheets of flexible plastic material;

pairs of adjacent cushions in any one assembly are delimited by a corresponding transverse weld whose ends stop short of the peripheral weld, to leave air communication passages;

at least one transverse weld is looped on itself and houses an information medium or the like, with at least one of the sheets of plastic material constituting the assembly(ies) concerned being transparent;

the outer sheet of plastic material in each of the assemblies is essentially plane, whereas the inner sheet may either be flat or else it may bulge over each of the cushions;

if the inner sheet has a bulging shape, this shape is obtained by welding the inner sheet to itself along dart lines running from the corner regions of each cushion, and optionally limited by internal tensioning strips;

the means for inflating each cushion assembly comprise a flexible pipe with the free end of the pipe being provided with an inflation end piece fitted with a valve, which valve is optionally common to both assemblies;

the box has a window through which the flexible pipe of at least one of the two assemblies is passed;

the window is situated level with a cavity in which the inflation end piece can be received after inflation; and a guarantee strip is fixed over said window.

The invention also provides a method of packaging an article using packaging as defined above, the method being characterized in that it comprises the following steps:

(a) closing the bottom closure of the box;
(b) disposing a first inflatable cushion assembly in the deflated state in the bottom of the box;
(c) disposing the articles to be packaged on the middle cushion and between the side cushions of said cushion assembly;
(d) disposing the second inflatable cushion assembly in the deflated state, on top of and on either side of the article;
(e) closing the top closure of the box; and
(f) inflating both inflatable cushion assemblies, with the first assembly being inflated later than step (c) and with the second assembly being inflated later than step (e), and with at least the second assembly being inflated from outside the box.

Other aspects and advantages of the present invention appear more clearly from reading the following detailed description of a preferred embodiment of the invention, given by way of example and made with reference to the accompanying drawings, in which:

DETAILED DESCRIPTION OF THE INVENTION

Figure 1A:
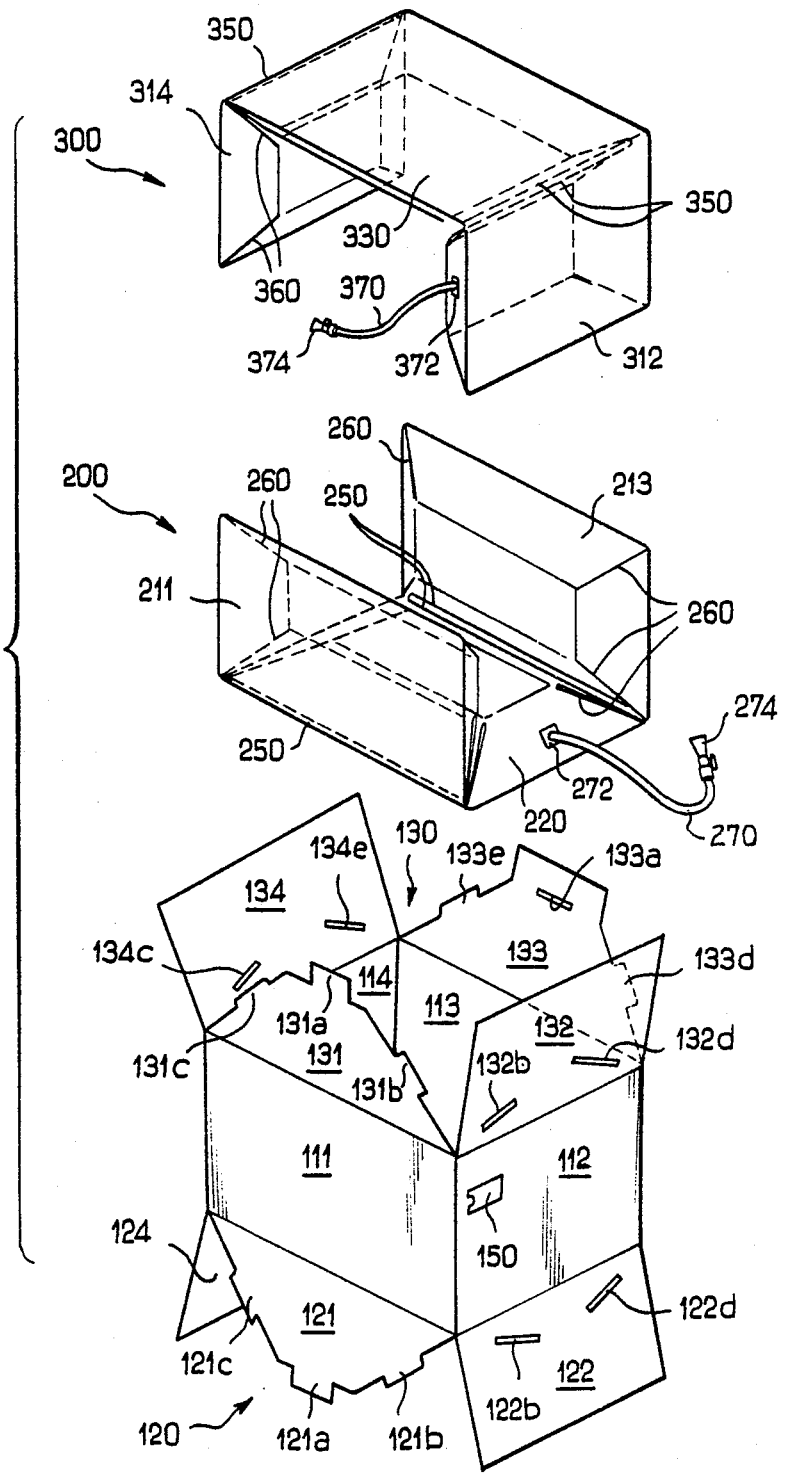
FIGS. 1*a* and 1*b* are perspective views, respectively an exploded and an assembled view, of packaging in accordance with the present invention.

With reference initially to FIG. 1*a*, packaging in accordance with the present invention is mainly constituted by a box 100 and by two inflatable assemblies 200 and 300 intended to be received intimately inside the box.

The box 100 is made of a single piece of corrugated cardboard or the like and is rectangular in shape in this case, having four side walls 111, 112, 113, and 114, and two closure assemblies 120 and 130 integral therewith and serving to close the bottom and the top thereof, respectively.

In accordance with an aspect of the present invention, each closure assembly 120 and 130 is of the semi-automatic type, e.g. like any one of the three examples shown.

Figure 1B:
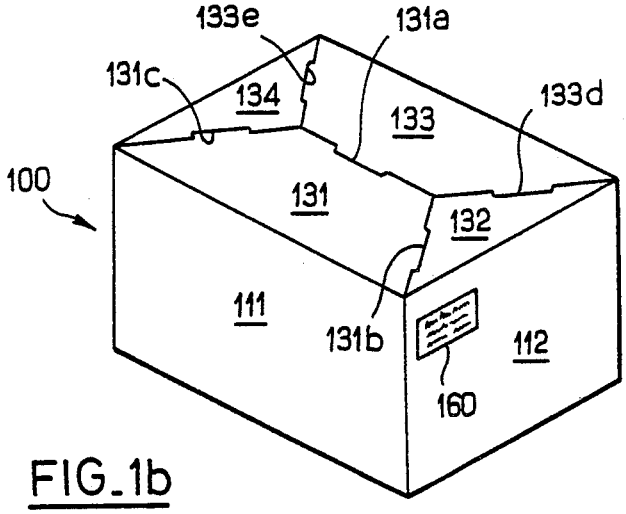
Figure 2A:
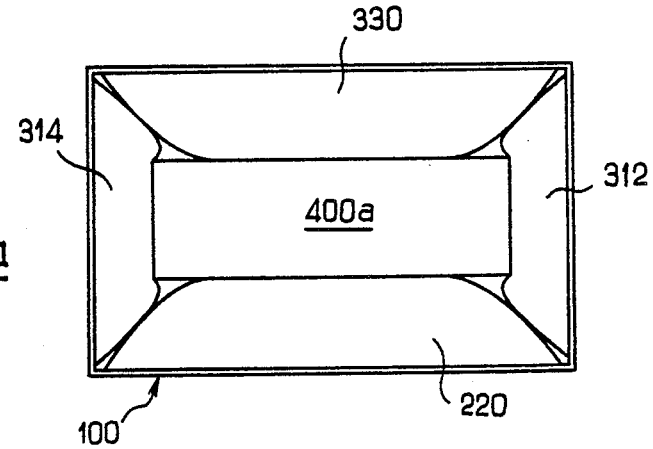
FIGS. 2*a* and 2*b* are diagrammatic section views through the packaging of FIGS. 1*a* and 1*b*, showing two articles of different sizes packaged therein.
Figure 2B:
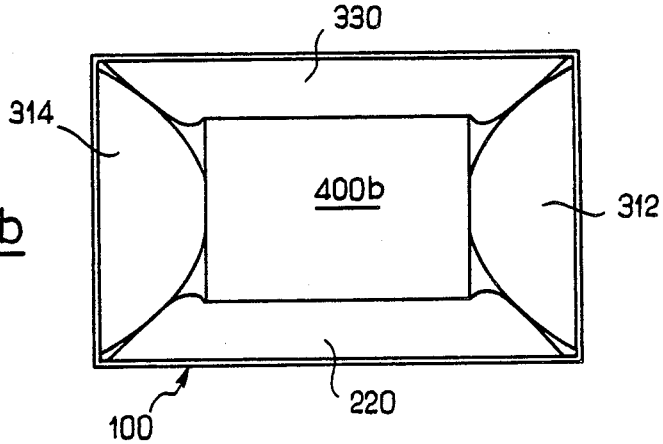
Figure 3A:
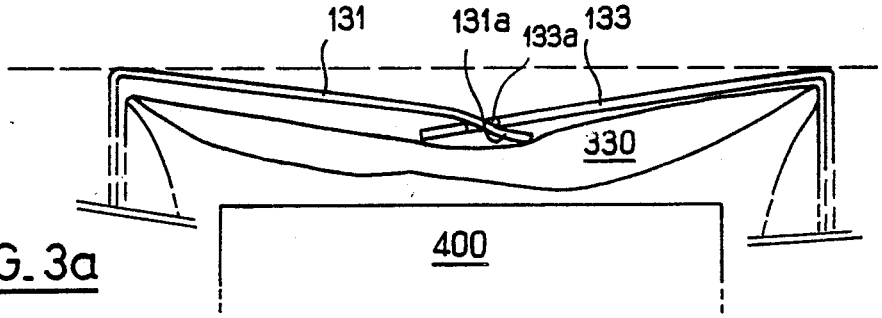
FIGS. 3*a* and 3*b* are detailed fragmentary cross-sections showing two states of the packaging in accordance with the invention.
Figure 3B:
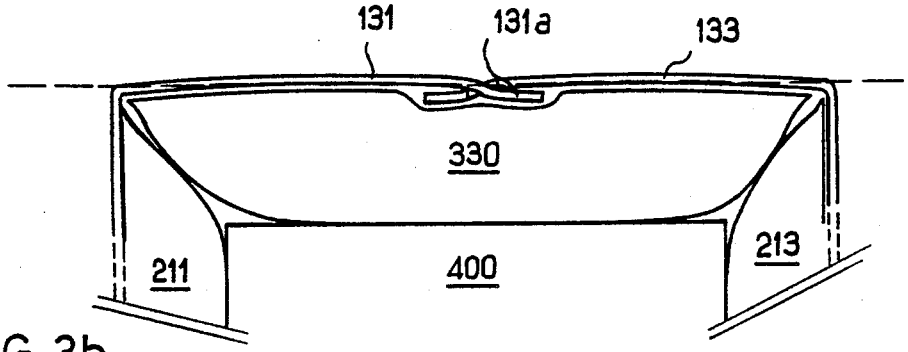

In the example of FIG. 1, the top closure assembly comprises a first trapezium-shaped flap 131 having a main locking tongue 131*a* projecting from its end furthest from its hinge. The opposite flap 133 is of substantially the same shape and includes a slot 133*a* for receiving the tongue 131*a* in order to close the assembly securely. Each of these two first flaps further includes two secondary tongues projecting from its sloping edges, with said secondary tongues being respectively referenced 131*b* and 131*c* and 133*d* and 133*e*.

Each of two rectangular side flaps 132 and 134 includes two slots respectively referenced 132*b* and 132*d* and 134*c* and 134*e* which are intended to receive said secondary tongues.

The bottom closure assembly 120 has an identical configuration of four flaps 121 to 124 having the same arrangements, respectively.

It is normal practise to provide a "semi-automatic" closure assembly to constitute the bottom closure of a cardboard box, while the top closure is normally constituted by rectangular flaps which are intended to be fastened together by adhesive tape or by staples.

This can be explained by the fact that a semi-automatic closure system having a central tongue has a first property of requiring all four flaps to be pushed a little way into the inside volume of the box before they can be conveniently locked together, and this can only be done when the box is partially empty. Further, in associated manner, such a closure system is adequately locked only when pressure is applied against all four flaps from inside the box. When such pressure is exerted the closure can no longer be unlocked from outside the box without damaging it in a visible manner.

Thus, a first feature of the invention lies in the fact that the box has two semi-automatic closures, a top closure and a bottom closure, for purposes which are explained below.

Figure 6:
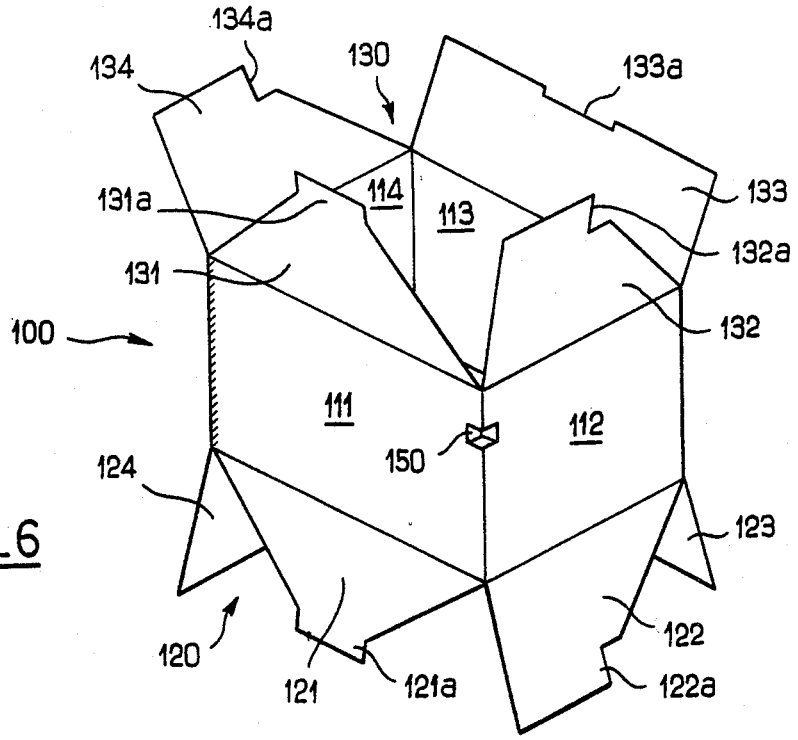
FIG. 6 is a perspective view of a variant of a portion of the packaging of the invention.
Figure 7:
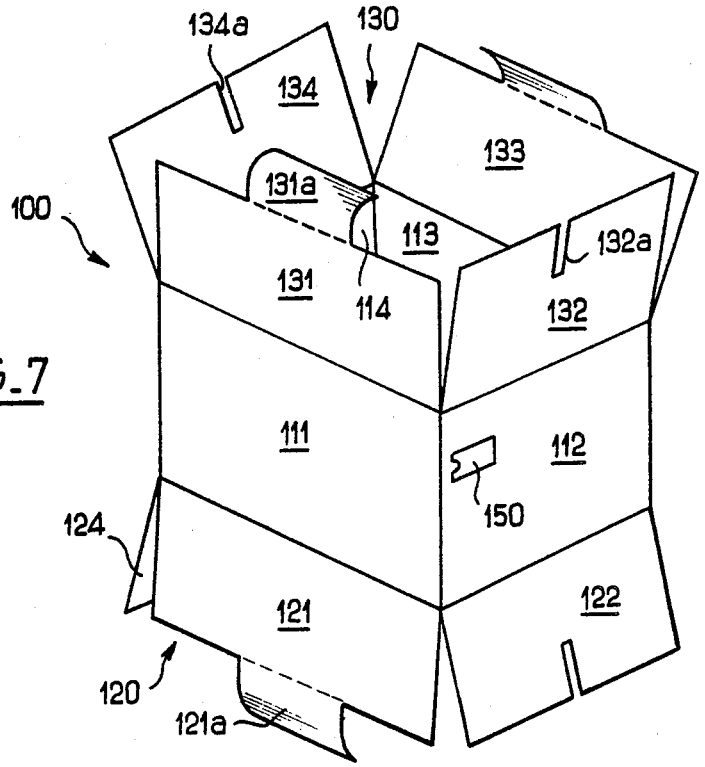
FIG. 7 is a perspective view of another variant of said portion.

As mentioned, other semi-automatic closure systems may be designed without going beyond the scope of the invention. In particular, FIGS. 6 and 7 illustrate two other designs of box suitable for semi-automatic closure, with said designs being shown while in the open position. These designs of box should be considered as being included in the present description. In this respect, portions which are identical or similar to corresponding portions in FIG. 1*a* have been designated by the same reference numerals, even though the order in which the flaps are folded shut is different.

In accordance with the invention, the packaging further includes a first inflatable assembly 200 made as a single piece which defines three inflatable cushions 220, 211, and 213 which are hinged to one another as shown in order to be capable of taking up a generally U-shaped section, so as to be engaged relatively closely against the bottom of the box 100 after its bottom closure 120 has been closed so as to define a bottom wall defined by the same reference numeral 120, with the cushions 220, 211, and 213 bearing respectively against the inside surfaces of the walls 120, 111, and 113 of the box, said cushions being identical in size or slightly smaller than the corresponding walls.

The assembly 200 is preferably made by welding together the edges of two sheets of flexible transparent plastic material. Weld lines 250 are also provided in the zones interconnecting pairs of adjacent cushions, however the ends of these weld lines stop short from the corresponding peripheral weld lines in order to leave pairs of intercommunicating passages. As a result, all three cushions 220, 211, and 213 communicate with one another.

As can be seen, the outside face of the assembly 200 is defined by a sheet of substantially plane plastic material so as to enable it to be pressed closely against the corresponding inside faces of the box.

In contrast, the respective inside faces of the cushions may either be plane or else they may be bulging, as illustrated and for reasons explained below.

Preferably, the bulging nature is obtained prior to peripheral welding by folding darts in the sheet itself and welding diagonally from the four corners over a given length along the dart lines as referenced at 260. As a result each cushion is roughly in the shape of a truncated pyramid with the thickness of the cushion being determined by the lengths of the dart lines 260.

However, it will naturally be understood that the cushions could be given any other bulging shape, e.g. by deforming the inside sheet of plastic material while hot, or by adding one or more internal tensioning strips, as explained below.

The single internal volume defined by the three cushions communicates with the outside via a flexible pipe 270 which is connected to the inflatable assembly 200 in air-tight manner at 272 and whose free end is fitted with a valve 274 including an inflation end piece, with a pushbutton or the like being provided in order to open the valve and deflate the assembly when so desired.

Packaging in accordance with the invention finally includes a second inflatable assembly 300 constituted identically to the first assembly 200. It includes a central cushion 330 and two side cushions 312 and 314 which are intended to be disposed respectively adjacent to the top wall 130 and to the side walls 112 and 114 of the box 100.

Similarly, this assembly is made by peripherally welding together two sheets of flexible plastic material which is optionally transparent, with a pair of weld lines 350 in a closed loop being provided at each transition between a pair of adjacent cushions, thereby hingeing the cushions together while still allowing air to communicate between adjacent cushions, with the air flowing between the ends of said transverse weld lines and the peripheral weld line.

The cushions of the second assembly are similarly generally pyramid-shaped (as shown), and this is achieved by means of dart lines 360 so that the inside sheet of plastic material is folded and welded to itself. However, flat inside faces could alternatively be provided.

Finally, a flexible pipe 370 is connected at 372 to the inflatable assembly and is provided at its free end with an assembly including a valve and an end piece 374 for inflation purposes enabling the assembly 300 to be inflated from outside the box as described below, and also enabling it to be deflated.

As can be seen, each of the two inflatable assemblies 200 and 300 has a generally U-shaped section, said sections occupying two perpendicular vertical planes with one of the U-shapes being upsidedown relative to the other, thereby enabling the two assemblies to be fitted together once installed inside the box 100 and defining six cushions against respective ones of the six inside faces of the box.

FIG. **1*b* shows the box 100 in the closed state. It may be observed, in particular, that the tongues 131*a*, 131*b*, 131*c*, 133*d*, and 133*e* are respectively inserted in corresponding slots 133*a*, 132*b*, 134*c*, 132*d*, and 134*e***.

The bottom closure system 120 is closed identically.

As shown in greater detail below, the inflation pressure of the cushions 220 and 330 situated inside the box and exerted respectively against the closures 120 and 130 provides a degree of outwardly directed pressure which serves effectively to lock these two closures.

FIGS. **2*a* and 2*b* are vertical sections through packaging in accordance with the present invention used in combination with two articles of different dimensions, and respectively referenced 400*a* and 400*b***. As can be seen, during inflation, each cushion fits itself closely against the facing wall of the packaged article.

In this respect, it may be observed that articles of very different sizes may be packaged, with the minimum size of packable articles being determined by the thickness to which the cushions can be inflated.

Thus, when single-sized packaging is to be used for packaging articles of very different sizes, the cushions may be designed to occupy volumes which are practically pyramid shaped, with their tips reaching points close to the geometrical center of the inside volume of the box.

FIGS. **3*a* and 3*b*** show a particular aspect of the behaviour of packaging in accordance with the present invention.

In the situation shown in FIG. **3*a*, an article 400 has been disposed inside the packaging and then covered by the top inflatable assembly 300 which is initially not inflated. This makes it easy to lock together the top inflatable assembly 300 since the flaps 131 to 134** can be pushed a little way into the inside volume of the box without the facing cushion offering any resistance.

Once the closure has been locked by the various tongues being received in the corresponding slots, the inflatable assembly 300 is inflated, thereby exerting upwardly directed pressure against the set of walls constituting the closure 130, and reinforcing the locking thereof by trapping the tongues closely between the flaps and the outside face of the cushion, as can be seen in FIG. **3*b* for the tongue 131*a***.

Similarily, the inflatable assembly 200 which is inserted in the bottom of the box prior to an article being inserted therein is also inflated after the article to be packaged has been put into place, and here again the assembly, once inflated, reinforces the locking action of the bottom closure 120.

As a result, normal opening of the box is prevented by its internal cushions being inflated.

Another major advantage provided by packaging in accordance with the invention may also be observed at this point. The closures 120 and 130 constitute indicators of the extent to which the inflatable assemblies 200 and 300 have been inflated. More precisely, when the top closure has taken up a substantially flat profile as shown in FIG. **3*b*, that means that the minimum inflation pressure has been achieved, not only for the cushion 330, but also for the cushions 312 and 314** which are in communication therewith.

Similarly, the closure 120 shows when minimum inflation pressure has been reached for the cushions 220, 211, and 213 of the bottom assembly 200.

In this respect, it may be observed that the semi-automatic closures of FIGS. 1 and 6 are themselves suitable for being pushed a little into the inside volume of the box under the influence of pressure exerted from the outside, unlike conventional closures having rectangular flaps.

Thus, the user can easily verify that the inflation pressures in the two cushion assemblies 200 and 300 are suitable, for example by pressing a hand against the two closures 120 and 130 and thus detecting whether the resistance they offer to being pushed in due to the resistance offered by the middle cushions 220 and 330 is appropriate.

Figure 4:
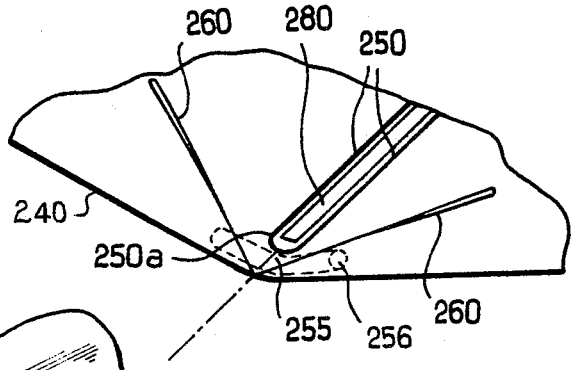
FIG. 4 is a perspective view of a detail of a portion of the packaging of the invention.

FIG. 4 shows a detail of the structure of an inflatable assembly in accordance with the present invention.

This figure shows the peripheral weld line 240 and the transverse weld line 250 which is constituted by a pair of lines that are looped together at 250*a*. A communication passage 255 is left between these two weld lines 240 and 250 to allow air to pass between two adjacent cushions, and a similar passage is provided at the opposite end of the transverse weld line.

In addition, in order to ensure that the communication passage 255 is not pinched shut by the assembly being folded through about 90° while it is being installed in the box (which would prevent air from passing therethrough), the welded dart lines 260 in the two adjacent cushions and as described above extend all the way to the peripheral weld line 240 level with the transverse weld line 250, as shown. Alternatively, a length of semi-rigid pipe 256 may be provided in the passage 255.

Further, in accordance with another feature of the invention, the completely closed space delimited by the transverse weld line 250 which is looped onto itself, may advantageously be used when the inflatable assembly is itself being assembled to receive a data medium 280, such as a piece of card, or a sheet of flexible plastic material, having any desired type of information marked thereon, e.g. identification or advertising information. In this case, at least one of the plastic material sheets constituting the inflatable assembly should be transparent.

Figure 5:
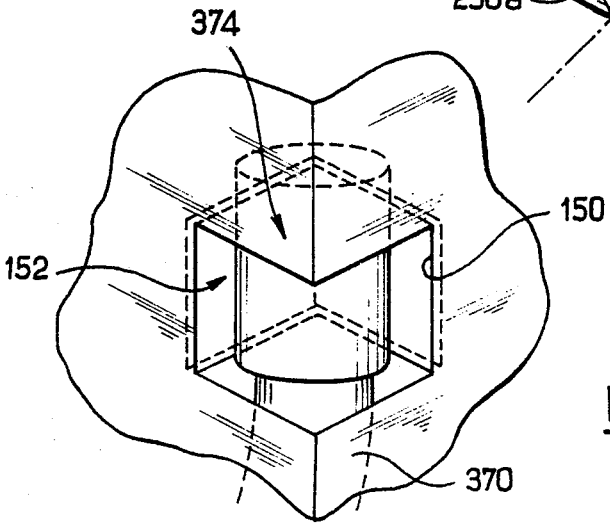
FIG. 5 is a perspective view of another detail of the packaging of the present invention.

As shown in FIGS. 1*a* and 5, it is advantageous to form a window 150 in the vicinity of one of the vertical edges of the box 100, e.g. by making a cut-out in one of two of the adjacent faces of the box along relatively short horizontal lines. In one particular embodiment, the regions situated between these two cut-outs is thrust into the inside space of the box in order to define a rectangular cavity 152, as clearly shown in FIG. 5.

This cavity is suitable for receiving and for holding in place the end piece 374 for inflating the top cushion assembly 300. A guarantee adhesive tape 160 (see FIG. 1*b*) can then be applied to the box 100 so as to cover the window 150 completely for reasons explained below.

Packaging in accordance with the invention is used, for example, as follows.

Initially, the box 100 is empty and its bottom closure 120 is closed and locked by assembling its flaps to one another and by inserting its locking tongue(s) into the corresponding slot(s), as described in greater detail above.

The inflatable assembly 200 is then inserted while in the deflated state into the bottom of the box and is prepositioned to receive the article to be packaged, with its side cushions 211 and 213 overlying the inside surfaces of the side walls 111 and 113 respectively of the box. Care is taken at this stage to ensure that the inflation end piece 274 remains easily accessible.

Once the article has been placed on the inflatable assembly 200, the assembly is inflated to a pressure which may be monitored using a pressure gauge, or merely by hand. At this moment, the locking of the bottom closure 120 of the box 100 is enhanced by the pressure exerted thereon from the inside of the box by means of the central cushion 220.

The pipe 270 and the end piece 274 can now be stored inside the box, e.g. along one of the edges at the bottom of the box.

The inflatable assembly 300 while in the deflated state is then put into place and its central cushion 330 overlies the article while its side cushions 312 and 314 press against the inside faces of the side walls 112 and 114 of the box which are left free by the bottom inflatable assembly 200.

The pipe 330 is then passed into the cavity 152 and through the window 150 so as to make the end piece 374 accessible from the outside, after which the top closure 130 of the box is closed and locked as described above. At this stage, the deflated state of the cushion 330 allows the flaps to be pushed into the box to some extent, thereby making it easier to lock them together.

The assembly 300 is then inflated from the outside via the end piece 374, with the top closure 130 itself constituting means for monitoring the degree of inflation, as described above.

The pipe 370 is then pushed back into the box (it is advantageous for the pipe to be relatively stiff, for this purpose), until the end piece 374 is received in the cavity 152. The guarantee strip 160 can then be put into place.

An interesting characteristic of this final stage (which is nevertheless merely optional in the context of the present invention) lies in that it is then impossible to open the box normally, i.e. without visibly damaging one or other of the two box closures, without initially deflating one of the two inflatable assemblies, and in particular it is impossible to open the box without tearing off the guarantee strip 160 in order to gain access to the end piece 374 which is normally operated for the purpose of obtaining such deflation.

As a result any non-authorized opening of the box can necessarily be detected.

Further, an interesting application of this feature of the invention relates to custom inspections. The seals used for transport of bonded goods can advantageously be replaced by an adhesive guarantee strip 160 having appropriate markings thereon.

Although the above description relates to an embodiment of packaging in accordance with the invention in which two cushion assemblies are inflated one after the other, it may be advantageous to inflate both cushion assemblies simultaneously, after both assemblies and the object to be packaged have been put into place inside the box and after the self-locking flap closures have been closed.

Figure 8A:
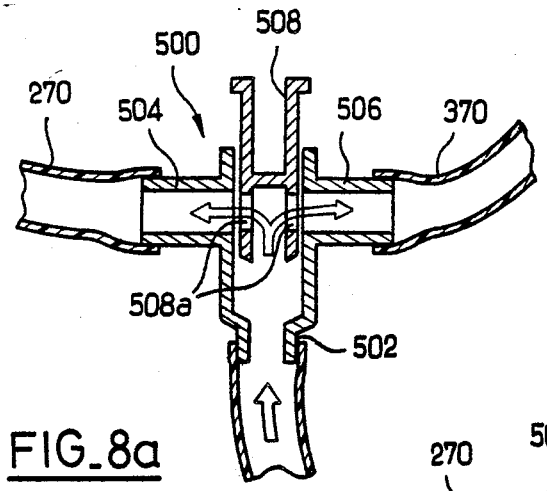
FIGS. 8*a* and 8*b* are diagrammatic section views through another portion of the packaging of the invention.
Figure 8B:
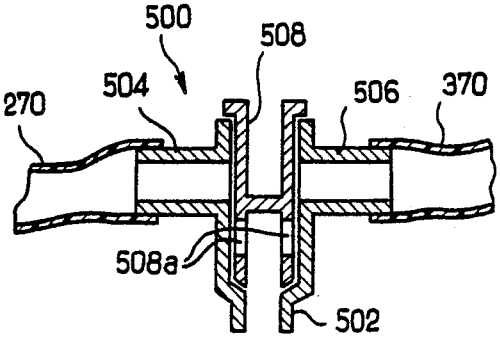

Thus, FIGS. 8*a* and 8*b* show a two-valve inflation end piece 500 comprising an inlet 502 for air under pressure and two outlets 504 and 506 which are connected to respective inflation pipes 270 and 370 leading to the two assemblies 200 and 300. A slider 508 biased by means of a return spring (not shown) is capable of taking up two positions: while air is being applied under pressure at 502 (FIG. 8*a*), it is thrust back by the incoming air pressure and it puts the inlet 502 into communication with the outlets 504 and 506 via two orifices 508*a*. The two assemblies 200 and 300 are therefore inflated to the same pressure.

As soon as the inlet pressure is removed, the slider 508 (FIG. 8*b*) is returned by the spring and take up a position in which it closes the outlets 504 and 506.

Thus, the slider 508 is not only a shutter member, it also serves, once inflation is over, to isolate the two cushion assemblies from each other.

In practice, this means that if a very heavy object is packaged, there is no danger of the bottom cushion assembly losing air to the top assembly under the effect of gravity.

The quality of the packaging is thus retained.

In another variant of the invention, it is possible to provide an end piece with one inlet and six outlets connected individually to the six cushions, in which case the cushion assemblies are such that the inside volumes of the cushions are isolated from one another.

Figure 9:
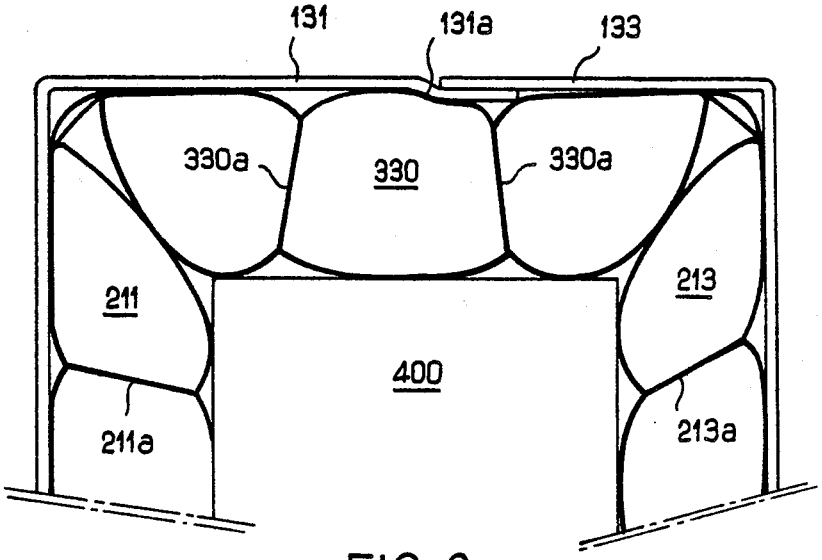
FIG. 9 is a section view through a detail of a variant embodiment of the invention.

Further, FIG. 9 is a cross-section through a variant embodiment of the cushions. In order to prevent the cushions from bulging too much on their outside faces (in this case cushions referenced 211, 213, and 330), a certain number of tensioning strips (in this case 211*a*, 213*a*, and 330*a*) are provided between the outside faces of the cushions and the corresponding inside faces that come into contact with the object 400. These strips may be fixed to said faces by welding, for example, and they are preferably made of the same material as the cushions, and in this example two such strips are provided per cushion. Naturally, all of the cushions or merely some of the cushions may be fitted with strips in this manner.

In practice, this means that if the cushions are over-inflated, the outside faces and in particular the top and bottom faces of the closed box do not bulge too much, e.g. while being over-inflated, since this would prevent the boxes from being stacked, and would, more generally, make them more difficult to handle.

Naturally, any other variant or modification may be applied to the invention by the person skilled in the art without going beyond the scope of the invention.

In particular, semi-automatic closure devices other than those described could be used.

Further, the box may be made of any appropriate material for implementing the type of closure under consideration, in particular, it may be made of card, paper board, corrugated card, or plastic of appropriate flexibility. Cardboard boxes in accordance with the invention and which are intended to be used several times over (unlike conventional packaging boxes), are advantageously coated with plastic in order to make it possible to apply and remove adhesive labels frequently without damaging the box surfaces.

Finally, the person skilled in the art will be capable of selecting a plastic material for the inflatable cushions which is sufficiently flexible to fit around the outline of the article to be packaged while simultaneously being strong enough to avoid being punctured by possible projecting or sharp portions on the articles.

The invention is advantageously applicable to transporting and handling any type of fragile goods, in particular electrical, electronic, computer, etc. devices, with the advantage of using a single type of packaging for an entire range of products with the packaging being reusable several times over.

We claim:

1. Packaging of the type comprising an outer rectangular box of rigid cardboard or the like, and a flexible inflatable structure situated inside the box and comprising, overlying each of the inside faces of the box, an inflatable cushion for coming into close contact with the article to be packaged, wherein:

the box includes a bottom closure and a top closure each having self-locking flaps;

the inflatable structure comprises two unit assemblies each comprising a central cushion overlying a respective one of the closures of the box, and two side cushions overlying respective side walls of the box, with each assembly further including means for simultaneously inflating its three cushions, with at least one of the assemblies being inflatable from outside the box; and the bottom and top closures of the box are held in the locked position by the pressure exerted thereon by the respective central cushions of the two assemblies of the inflatable structure, once inflated.

2. Packaging according to claim 1, wherein each of the top and bottom closures of the box comprises a first flap including at least one locking tongue, together with three other flaps defining one or more slots, wherein each slot corresponds to each locking tongue.

3. Packaging according to claim 1, wherein each assembly of the inflatable structure is made by peripherally welding together two sheets of flexible plastic material.

4. Packaging according to claim 3, wherein pairs of adjacent cushions in any one assembly are delimited by a corresponding transverse weld whose ends stop short of the peripheral weld, to leave air communication passages.

5. Packaging according to claim 4, wherein at least one transverse weld is looped on itself and houses an information medium or the like, wherein at least one of the sheets of plastic material constituting at least one of the assemblies concerned is transparent.

6. Packaging according to claim 3, wherein each central cushion includes at least one tensioning strip extending inside the cushion between the inside and outside sheets of plastic material.

7. Packaging according to claim 3, wherein the two sheets of plastic material in each cushion assembly are essentially plane.

8. Packaging according to claim 3, wherein the outer sheet of each cushion assembly is essentially plane, while its inner sheet has a bulging shape for each cushion, said shape being obtained by welding the inner sheet to itself along folded dart lines, said dart lines running for a predetermined length from the corner regions of each cushion towards the center region of the inner sheet.

9. Packaging according to claim 1, wherein the means for inflating each cushion assembly comprise a flexible pipe with the free end of the pipe being provided with an inflation end piece fitted with a valve.

10. Packaging according to claim 9, wherein the inflation end piece is common to both cushion assemblies.

11. Packaging according to claim 9, wherein the box has a window through which the flexible pipe of at least one of the two assemblies is passed.

12. Packaging according to claim 11, wherein the window is situated level with a cavity in which the inflation end piece can be received after inflation.

13. Packaging according to claim 11, further including a guarantee strip fixed over said window.

* * * * *